US006007767A

United States Patent [19]

Fujita et al.

[11] Patent Number: 6,007,767

[45] Date of Patent: Dec. 28, 1999

[54] HIGH CHROMIUM HEAT RESISTANT CAST STEEL MATERIAL

[75] Inventors: Akitsugu Fujita; Masatomo Kamata, both of Nagasaki; Yasunori Tashiro; Koji Morinaka, both of Kitakyusyu, all of Japan

[73] Assignee: Mitsubishi Heavy Industries, Ltd., Japan

[21] Appl. No.: 09/008,593

[22] Filed: Jan. 16, 1998

[30] Foreign Application Priority Data

Jan. 27, 1997 [JP] Japan ..... 9-012675
Apr. 28, 1997 [JP] Japan ..... 9-110976

[51] Int. Cl.[6] ..... C22C 38/22; C22C 38/24

[52] U.S. Cl. ..... 420/38; 420/39

[58] Field of Search ..... 420/38, 39; 148/325

[56] References Cited

FOREIGN PATENT DOCUMENTS 0 188 995 7/1986 European Pat. Off. .
0 688 883 12/1995 European Pat. Off. .

OTHER PUBLICATIONS

*Patent Abstracts of Japan*, 95(11), abstract of JP 07–197208 (Aug. 1995).

*Primary Examiner*—Deborah Yee
*Attorney, Agent, or Firm*—Wenderoth, Lind & Ponack, L.L.P.

[57] ABSTRACT

A heat resistant material and a pressure vessel by use thereof, having an excellent high temperature strength so as to be applicable to steam condition of 600° C. or more, are provided. Said material consists of C, Si, Cr, Ni, V, Nb, N, Mo and W in the respective weight percent, and inevitable impurities and Fe, and is further added with Cu, B and Ca and/or Mn, Mn and Cu, B and Ca, in the respective weight percent. Also, a pressure vessel is formed of said materials.

6 Claims, No Drawings

HIGH CHROMIUM HEAT RESISTANT CAST STEEL MATERIAL

BACKGROUND OF THE INVENTION

1. Field of the Invention

The present invention relates to a high chromium heat resistant cast steel material applicable to a thermal power generation steam plant etc. and to a pressure vessel, such as a steam turbine casing, formed thereof.

2. Description of the Prior Art

As a heat resistant material applied to a thermal power generation steam plant in the prior art, there have been used CrMo cast steel, 2.25% CrMo cast steel, CrMoV cast steel, 12 Cr cast steel, etc.

In the heat resistant material applied to the thermal power generation plant in the prior art, use of a cast steel material of a low alloy steel, such as CrMo cast steel, 2.25% CrMo cast steel, CrMoV cast steel and the like, has been limited to a plant of steam temperature of up to 566° C. for reason of limitation of a high temperature strength.

On the other hand, 12 Cr cast steel material (as disclosed by the Japanese laid-open patent application Sho 59-216322, for example), which is superior in the high temperature strength to the cast steel made of the low alloy steel, can be applied to a plant of steam temperature of nearly up to 600° C., but being short of a higher temperature strength, it is hardly applied as a pressure vessel of a steam turbine casing and the like.

SUMMARY OF THE INVENTION

In order to solve said problem in the prior art, it is an object of the present invention to provide a high chromium (Cr) heat resistant cast steel material which is applicable to a steam condition of 600° C. or more with an excellent high temperature strength.

(1) One feature of the present invention is that the high Cr heat resistant cast steel material consists of carbon (C) of 0.08 to 0.14%, silicon (Si) of 0.10 to 0.30%, chromium (Cr) of 8 to 10%, nickel (Ni) of 0.01 to 0.60%, vanadium (V) of 0.1 to 0.2%, niobium (Nb) of 0.03 to 0.06%, nitrogen (N) of 0.02 to 0.07%, molybdenum (Mo) of 0.1 to 0.7%, tungsten (W) of 1 to 2.5% and cobalt of 0.01 to 2%, all in weight percent, and inevitable impurities and iron (Fe).

The present invention, which provides a new material having an excellent high temperature characteristics for a pressure vessel of a steam turbine casing and the like, has been made by the inventors here as the result of elaboration for improving the high temperature strength by strict selections of the alloy elements on the basis of a high chromium steel as the fundamental component, and the reason for defining the respective component in the present invention is described below.

C together with N forms a carbon nitride to contribute to enhancing a creep rupture strength. Also, C acts as an austenite forming element to suppress generation of δ ferrite. C of less than 0.08% cannot give a sufficient effect and, if C exceeds 0.14%, the carbon nitride coheres to become coarse while being used and deteriorates the high temperature long term strength.

Further, as C amount becomes larger, weldability deteriorates, so that there occur shortcomings as weld cracking in the manufacture of pressure vessels etc. So, it is necessary not to add C more than needed, except the case of improving the high temperature strength as a carbon nitride or of suppressing generation of δ ferrite. Thus, C is set to 0.08 to 0.14%.

Si has an effect as a deoxidizing agent. Also, in the case of cast steel, flowability of molten metal is needed as it is necessary to flow into every corner of a mold and Si is a necessary element for securing the flowability of molten metal.

Si, however, lowers both toughness and high temperature strength and also has effect of accelerating generation of δ ferrite, hence it is necessary to make Si as low as possible. Si of less than 0.1% is not sufficient to secure the flowability of molten metal and if Si is added in excess of 0.3%, the above-mentioned shortcomings arise. Thus, Si is set to 0.1 to 0.3%.

Cr forms a carbide to contribute to improving the creep rupture strength and, melting into the matrix concurrently, to improve the oxidation resistance as well as, strengthening the matrix itself, to contribute to enhancing the high temperature long term strength. Cr of less than 8% has no sufficient effect and if Cr is added in excess of 10%, δ ferrite is easily generated, resulting in lowering the strength and deteriorating the toughness. Thus, Cr is set to 8 to 10%.

Ni is an effective element for improving the toughness. It is also effective for suppressing generation of δ ferrite. But if added too much, it deteriorates the creep rupture strength greatly. So, addition thereof to the necessary minimum extent is preferable. If Ni in excess of 0.6% is added, the creep rupture strength lowers remarkably. Further, Ni amount mixed in a steel material inevitably is considered approximately 0.01%, hence Ni is set to 0.01 to 0.6%.

V forms a carbon nitride to improve the creep rupture strength. V of less than 0.1% gives no sufficient effect. Reversely, if it is added in excess of 0.2%, the creep rupture strength will rather be lowered. Hence, V is set to 0.1 to 0.2%.

Nb forms a carbon nitride to contribute to improving the high temperature strength. Also, it fines a carbide ($M_{23}C_6$) precipitating at a high temperature to contribute to improving the long term creep rupture strength. Nb of less than 0.03% has no good effect and if it is added in excess of 0.06%, the carbon nitride of Nb generated in the manufacture of steel ingot cannot make a solid solution sufficiently in the matrix at the time of heat treatment and becomes coarse while being used, so that the long term creep rupture strength is lowered. Thus, Nb is set to 0.03 to 0.06%.

N together with C and alloy elements forms a carbon nitride to contribute to improving the high temperature strength. Also, it has an effect to suppress generation of δ ferrite and is an important element in the present invention in which addition of Mn is not taken place.

N of less than 0.02% cannot form a sufficient carbon nitride nor give a sufficient effect to suppress generation of δ ferrite, with result that no sufficient creep rupture strength is obtained and the toughness is deteriorated. If N is added in excess of 0.07%, the carbon nitride coheres to become coarse after a long term, so that a sufficient creep rupture strength becomes unobtainable. Thus, N is set to 0.02 to 0.07%.

Mo together with W makes a solid solution in the matrix to improve the creep rupture strength. If Mo is to be added singly, its addition of as high as approximately 1.5% will be possible but if W is added together in a range of 1 to 2.5%, W is more effective in improving the high temperature strength. Also, if Mo and W are added too much, δ ferrite is generated to deteriorate the creep rupture strength. Thus, in a balance of added amount of W, Mo addition is set to 0.1 to 0.7%.

W together with Mo as mentioned above makes a solid solution in the matrix to improve the creep rupture strength. W, having a higher solid solution strengthening function than Mo, is an effective element. But if added too much, it generates δ ferrite and a large amount of Laves phases, so that the creep rupture strength is deteriorated reversely. Therefore, in a balance of addition amount of Mo, W addition is set to 1 to 2.5%.

Co, same as Ni, makes a solid solution in the matrix to suppress generation of δ ferrite. It does not deteriorate the high temperature strength, differently from Ni. If Co is added, therefore, such solid solution strengthening element as Cr and W can be added more as compared with the case of no Co being added, with result that a higher creep rupture strength becomes obtainable.

Addition of Co in excess of 2%, however, accelerates precipitation of carbide, so that the long term creep rupture strength with be deteriorated. Further, Co is a costly element and is added preferably as low as possible economically. On the other hand, Co of 0.01% or so is contained in a steel material as an inevitably mixed amount, if not specifically added, hence the addition amount of Co in the present invention is set to 0.01 to 2%.

In the material of the present invention, it is one feature that other elements than those mentioned above are not contained therein except those inevitably mixed as impurities, that is, no addition of such other elements is made intentionally. The reason therefor is described below on several elements.

Manganese (Mn) is a useful element as a deoxidizing agent. Also, it functions to suppress generation of δ ferrite. On the other hand, as elements are increased, creep rupture strength deteriorates. For this reason, addition of Mn is done with an appropriate amount within less than 1% in the prior art, but in case of a material in which enhancement of the high temperature strength is indispensable, addition of Mn is made as low as possible and enhancement of the high temperature strength, especially the creep rupture strength, is to be given a first priority. Hence, Mn is not added in the present invention specifically.

In this case, there occurs sometimes a problem of generation of δ ferrite. So, addition of C, Ni, N, Co, Cu, etc. which are also austenite generation elements is done with an appropriate amount and generation of δ ferrite is suppressed. Thus, no Mn is added intentionally except that it is mixed as an inevitable impurity.

Titanium (Ti), combined with oxygen, forms an oxide. So, it is an element that easily causes a defect of material. Especially, the cast steel material is taken on the premise of no forging process being included, and as the oxide and the base metal cannot be closely bonded together even by forging, securing of cleanliness of the material is important. Accordingly, no Ti is added in the present invention.

Aluminum (Al) also is an element to form an oxide to lower cleanliness of the material, same as Ti.

Accordingly, no Al is added in the present invention for same reason as in the case of Ti.

In the present invention, the respective element gives actions as mentioned above, hence a heat resistant material having a more excellent high temperature strength as compared with the prior art heat resistant material can be realized.

(2) Another feature of the present invention is that the high Cr heat resistant cast steel material consists of carbon (C) of 0.08 to 0.14%, silicon (Si) of 0.10 to 0.30%, chromium (Cr) of 8 to 10%, nickel (Ni) of 0.01 to 0.60%, vanadium (V) of 0.1 to 0.2%, niobium (Nb) of 0.03 to 0.06%, nitrogen (N) of 0.02 to 0.07%, molybdenum (Mo) of 0.1 to 0.7%, tungsten (W) of 1 to 2.5%, cobalt of 0.01 to 2% and copper (Cu) of 0.02 to 2.5%, all in weight percent, and inevitable impurities and iron (Fe).

The present invention, which provides a new material having an excellent high temperature characteristics for a pressure vessel of a steam turbine casing and the like, has also been made by the inventors here as the result of elaboration for improving the high temperature strength by strict selections of the alloy elements on the basis of a high Cr steel as the fundamental component, and the reason for defining the respective component except Cu in the present invention is as described in (1) above with repeated description being omitted and the reason for defining Cu which is newly added is as follows:

Cu is effective as an element to suppress δ ferrite. Also, Cu itself precipitates finely in the matrix to be effective to improve the high temperature strength. If it is added too much and held in a high temperature state of more than 1000° C., however, it causes a boundary precipitation to form a Cu phase of low melting point and its weldability is damaged.

Judging from the weldability, addition of Cu is preferably set to 2.5% or less. Further, Cu of 0.02% or so is mixed in the ordinary steel material as an impurity. Addition of Cu is, therefore, set to 0.02 to 2.5%.

In the present invention, Cu is added to the components of the invention of (1) above, thereby such a head resistant material as is more improved in the high temperature strength than the material of the invention of (1) above can be realized.

(3) Further feature of the present invention is that the high Cr heat resistant cast steel material consists of carbon (C) of 0.08 to 0.14%, silicon (Si) of 0.10 to 0.30%, manganese (Mn) of 0.01 to 1.0%, chromium (Cr) of 8.0 to 9.5%, nickel (Ni) of 0.01 to 0.60%, vanadium (V) of 0.1 to 0.2%, niobium (Nb) of 0.03 to 0.06%, nitrogen (N) of 0.02 to 0.07%, molybdenum (Mo) of 0.1 to 0.7%, tungsten (W) of 1.5 to 2.5% and cobalt of 0.01 to 2%, all in weight percent, and inevitable impurities and iron (Fe).

The present invention, which provides a new material having an excellent high temperature characteristics for a pressure vessel of a steam turbine casing and the like, has also been made by the inventors here as the result of elaboration for improving the high temperature strength by strict selections of the alloy elements on the basis of a high Cr steel as the fundamental component, and the reason for defining the respective component of C, Si, Ni, V, Nb, N, Mo and Co in the present invention is as described in (1) above with repeated description being omitted and the reason for defining Mn which is newly added and Cr and W of which addition amount is changed is as follows.

Mn is a useful element as a deoxidizing agent as mentioned above. Also, it functions to suppress generation of δ ferrite. If δ ferrite is generated, the ductility and the toughness lower and further the creep rupture strength which is a high temperature strength also lowers remarkably. Therefore, addition of Mn is to be made in consideration of the balance of other elements.

On the other hand, as elements are increased, the creep rupture strength deteriorates. For this reason, in order not to damage the creep rupture strength and moreover to cause no δ ferrite to be generated when a large cast steel product is being manufacture, addition amount of Mn must be well controlled.

If Mn of more than 1% is added, the high temperature strength lowers remarkably, hence it is to be added at 1% or less. Also, Mn amount of 0.01% or so is considered mixed in the steel material inevitably. Thus, Mn is set to 0.01 to 1%.

It is to be noted that the invention of (1) and (2) above is featured in being added with no Mn. This is for the reason that enhancement of the creep rupture strength is intended firstly, but in this case, strict selections of the material become necessary and cost increase is incurred. Also, there is a risk to generate a harmful δ ferrite unless strict controls are done against component segregation etc. although differently according to the size of products, manufacturing conditions, etc.

In the present invention in which Mn is added, admitting the phenomenon that the creep rupture strength is lowered by addition of Mn, importance is put on suppressing the cost and lowering the risk of generating δ ferrite.

Cr forms a carbide to contribute to improving the creep rupture strength and, melting in the matrix, to improve the oxidation resistance as well as, strengthening the matrix itself, to contribute to enhancing the high temperature long term strength. Cr of less than 8.0% has no sufficient effect and if Cr is added in excess of 9.5%, δ ferrite is easily generated to lower the strength and deteriorate the toughness although there is a relation with other alloy elements.

Thus, Cr is set to 8.0 to 9.5%. It is to be noted that the reason why the upper limit of Cr in the invention of (1) above is lowered is that importance is put on lowering the risk of generating the harmful δ ferrite.

W together with Mo as mentioned above makes a solid solution in the matrix to improve the creep rupture strength. W, having a higher solid solution strengthening function than Mo, is an effective element. But if added too much, it generates δ ferrite and a large amount of Laves phases, so that the creep rupture strength is deteriorated reversely. Therefore, in a balance of addition amount of Mo, W addition is set to 1.5 to 2.5%. It is to be noted that the reason why the lower limit of W in the invention of (1) above is raised is that the creep rupture strength which is lowered by addition of Mn is to be compensated by W.

(4) Further feature of the present invention is that the high Cr heat resistant cast steel material consists of carbon (C) of 0.08 to 0.14%, silicon (Si) of 0.10 to 0.30%, manganese (Mn) of 0.01 to 1.0%, chromium (Cr) of 8.0 to 9.5%, nickel (Ni) of 0.01 to 0.60%, vanadium (V) of 0.1 to 0.2%, niobium (Nb) of 0.03 to 0.06%, nitrogen (N) of 0.02 to 0.07%, molybdenum (Mo) of 0.1 to 0.7%, tungsten (W) of 1.5 to 2.5%, cobalt of 0.01 to 2% and copper (Cu) of 0.02 to 2.5%, all in weight percent, and inevitable impurities and iron (Fe).

The present invention, which provides a new material having an excellent high temperature characteristics for a pressure vessel of a steam turbine casing and the like, has also been made by the inventors here as the result of elaboration for improving the high temperature strength by strict selections of the alloy elements on the basis of a high Cr steel as the fundamental component, and the reason for defining the amount of Cu which is newly added to the invention of (3) above is same as described in the invention of (2) above.

In the present invention, Cu is added to the components of the invention of (3) above, thereby such a heat resistant material as is more improved in the high temperature strength than the invention of (3) above can be realized.

(5) Further feature of the present invention is that the high Cr heat resistant cast steel material described in any one invention of (1) to (4) above is added with boron (B) of 0.002 to 0.010%.

The present invention, which provides a new material having an excellent high temperature characteristics for a pressure vessel of a steam turbine casing and the like, has also been made by the inventors here as the result of elaboration for improving the high temperature strength by strict selections of the alloy elements on the basis of a high Cr steel as the fundamental component, and the reason for defining the amount of B which is newly added in the present invention is described below.

B has a function to enhance a boundary strength. Thus, it contributes to improving the creep rupture strength. But if added too much, it lowers toughness and if added less than 0.002%, it will exhibit no sufficient effect of addition. Hence, addition amount of B is set to 0.002 to 0.01%.

In the present invention, B is added to the components of any one invention of (1) to (4) above, thereby such a heat resistant material as is more improved in the high temperature strength than any invention of (1) to (4) above can be realized.

(6) Further feature of the present invention is that the high Cr heat resistant cast steel material described in any one invention of (1) to (5) above is added with calcium (Ca) of 0.001 to 0.009%.

The present invention, which provides a new material having an excellent high temperature characteristics for a pressure vessel of a steam turbine casing and the like, has also been made by the inventors here as the result of elaboration for improving the high temperature strength by strict selections of the alloy elements on the basis of a high Cr steel as the fundamental component, and the reason for defining the amount of Ca which is newly added in the present invention is described below.

Ca spheroidizes intervening matters to disperse them finely and accelerates growth of equiaxed crystals by its inoculation effect to reduce macro segregations of the harmful impurity elements of sulfur etc. Also, it has an effect to lower the melting point of the intervening substances to make them easily removable in the smelting process.

As the result thereof, the toughness and the high temperature strength characteristics of the material are enhanced. Especially, in the cast steel material (the invented material), there is no way to dissolve bonding and segregation of the intervening matters and the base metal in the processing of materials by forging etc., hence addition of Ca here is effective.

Addition amount of Ca of less than 0.001% gives no effective action, hence the lower limit is set to 0.001%. Also, if added too much, it generates a large amount of Ca oxide to lower cleanliness of the material, hence the upper limit of addition is set to 0.009%. The preferable range of Ca addition is 0.002 to 0.006%.

In the present invention, Ca is added to the components of any one invention of (1) to (5) above, thereby such a heat resistant material as is more improved in the high temperature strength than any invention of (1) to (5) above can be realized.

(7) Further feature of the present invention is that a pressure vessel is formed of the high Cr heat resistant cast steel material of any one invention of (1) to (6) above.

As the high Cr heat resistant cast steel material of any one invention of (1) to (6) above has all an excellent high temperature strength, the pressure vessel formed of that material can be well used in a ultra supercritical pressure power generation plant etc.

DESCRIPTION OF THE PREFERRED EMBODIMENTS

A high chromium (Cr) heat resistant cast steel material of a first embodiment according to the present invention is described. The high Cr heat resistant cast steel material of the first embodiment consists of carbon (C) of 0.08 to 0.14%, silicon (Si) of 0.10 to 0.30%, chromium (Cr) of 8 to 10%, nickel (Ni) of 0.01 to 0.60%, vanadium (V) of 0.1 to 0.2%, niobium (Nb) of 0.03 to 0.06%, nitrogen (N) of 0.02 to 0.07%, molybdenum (Mo) of 0.1 to 0.7%, tungsten (W) of 1 to 2.5% and cobalt of 0.01 to 2%, all in weight percent, and inevitable impurities and iron (Fe).

With respect to the first embodiment, various tests have been done for confirmation of characteristics on invented materials 1 within the range of the above-mentioned components as well as on comparison materials, and contents and results thereof are described below. Chemical components of the materials used in the tests are shown in Table 1 for the invented materials 1 and in Table 2 for the comparison materials.

All the materials are melted by a 50 kg vacuum high frequency melting furnace and the molten metal is poured into a sand mold to form test materials. For heat treatment of each of the test materials, quenching is first applied in simulation that a thickness center portion of a steam turbine casing which is 400 mm thick is quenched and cooled by air and then tempering is applied at a tempering temperature of each material decided such that the 0.2% yield strength corresponds to approximately 63 to 68 kgf/mm$^2$.

Table 3 shows the mechanical characters and the creep rupture strength (extrapolated value) after 100,000 hours at temperature of 625° C. as the results of various tests made on the invented materials 1 and the comparison materials.

TABLE 1

| Classification | Nos. of Test materials | C | Si | Mn | Cr | Ni | V | Nb | Mo | W | Co | N |
|---|---|---|---|---|---|---|---|---|---|---|---|---|
| Invented materials 1 | 1 | 0.12 | 0.12 | 0.01 | 8.5 | 0.02 | 0.11 | 0.04 | 0.25 | 1.8 | 1.7 | 0.03 |
| | 2 | 0.12 | 0.22 | 0.01 | 8.8 | 0.50 | 0.18 | 0.04 | 0.65 | 1.0 | 1.5 | 0.03 |
| | 3 | 0.12 | 0.28 | 0.01 | 9.0 | 0.50 | 0.17 | 0.04 | 0.65 | 1.2 | 1.9 | 0.04 |
| | 4 | 0.08 | 0.18 | 0.01 | 9.0 | 0.50 | 0.18 | 0.05 | 0.65 | 1.4 | 1.9 | 0.04 |
| | 5 | 0.13 | 0.18 | 0.01 | 9.0 | 0.45 | 0.18 | 0.05 | 0.65 | 1.8 | 1.0 | 0.05 |
| | 6 | 0.09 | 0.19 | 0.00 | 8.2 | 0.40 | 0.15 | 0.05 | 0.50 | 1.6 | 1.9 | 0.05 |
| | 7 | 0.09 | 0.18 | 0.01 | 9.0 | 0.55 | 0.15 | 0.05 | 0.15 | 2.0 | 0.5 | 0.04 |
| | 8 | 0.10 | 0.18 | 0.00 | 9.7 | 0.55 | 0.15 | 0.05 | 0.15 | 2.4 | 1.9 | 0.04 |
| | 9 | 0.10 | 0.19 | 0.01 | 8.5 | 0.10 | 0.12 | 0.04 | 0.43 | 2.1 | 0.1 | 0.05 |
| | 10 | 0.10 | 0.17 | 0.01 | 9.0 | 0.10 | 0.12 | 0.04 | 0.35 | 2.5 | 1.5 | 0.05 |

TABLE 2

| Classification | Nos. of Test materials | C | Si | Mn | Cr | Ni | V | Nb | Mo | W | Co | N |
|---|---|---|---|---|---|---|---|---|---|---|---|---|
| Comparison materials | 11 | 0.12 | X0.35 | 0.00 | 9.0 | 0.10 | X0.25 | 0.02 | X0.05 | 1.6 | 1.0 | 0.05 |
| | 12 | 0.12 | X0.45 | 0.01 | 9.0 | 0.20 | 0.15 | 0.05 | X0.05 | 1.8 | X3.0 | X0.01 |
| | 13 | 0.10 | 0.18 | X0.60 | X10.5 | 0.20 | 0.15 | 0.05 | 0.20 | X0.7 | 0.5 | X0.01 |
| | 14 | 0.10 | 0.17 | X0.80 | X10.5 | 0.30 | 0.15 | 0.05 | 0.20 | X0.7 | 0.5 | 0.03 |
| | 15 | 0.10 | 0.18 | 0.01 | 9.5 | X0.70 | X0.25 | 0.06 | 0.20 | X0.9 | 0.5 | 0.04 |
| | 16 | 0.11 | X0.50 | X0.20 | 9.0 | X0.85 | 0.15 | 0.06 | X0.80 | 2.5 | 1.5 | 0.05 |
| | 17 | X0.20 | X0.43 | 0.01 | X7.0 | 0.40 | 0.15 | X0.08 | X0.80 | 2.4 | 1.5 | 0.05 |
| | 18 | X0.25 | X0.38 | X1.05 | 9.0 | 0.40 | 0.18 | X0.08 | X0.82 | X2.8 | 2.5 | X0.08 |
| | 19 | X0.07 | 0.20 | 0.01 | X11.0 | 0.50 | 0.18 | X0.10 | X1.00 | 2.1 | 1.9 | X0.10 |
| | 20 | X0.06 | 0.20 | 0.01 | X8.5 | 0.50 | 0.18 | X0.10 | X1.00 | 1.0 | X3.8 | X0.10 |

X mark shows a figure outside of the weight percent range of the present invention.

TABLE 3

| | | Ordinary temperature tension tests | | | | 2 mmV Impact | 625° C. × 10$^5$ hours |
|---|---|---|---|---|---|---|---|
| Classification | Nos. of Test materials | 0.2% Yield strength (kgf/mm$^2$) | Tension strength (kgf/mm$^2$) | Elongation (%) | Reduction of area (%) | value at 20° C. (kgf-m) | Creep rupture strength (kgf/mm$^2$) |
| Invented materials 1 | 1 | 65.3 | 80.5 | 20.5 | 68.8 | 5.4 | 10.2 |
| | 2 | 65.4 | 78.8 | 21.2 | 67.9 | 5.6 | 10.3 |
| | 3 | 64.8 | 79.6 | 22.6 | 69.8 | 6.8 | 9.7 |
| | 4 | 66.9 | 81.2 | 24.3 | 72.5 | 7.0 | 9.6 |
| | 5 | 65.4 | 80.6 | 20.5 | 69.4 | 7.2 | 10.4 |

TABLE 3-continued

| Classification | Nos. of Test materials | Ordinary temperature tension tests: 0.2% Yield strength (kgf/mm$^2$) | Tension strength (kgf/mm$^2$) | Elongation (%) | Reduction of area (%) | 2 mmV Impact value at 20° C. (kgf-m) | 625° C. × $10^5$ hours Creep rupture strength (kgf/mm$^2$) |
|---|---|---|---|---|---|---|---|
| | 6 | 64.7 | 81.2 | 25.6 | 73.1 | 6.0 | 10.3 |
| | 7 | 63.8 | 80.4 | 24.8 | 71.6 | 6.4 | 10.5 |
| | 8 | 67.8 | 82.7 | 23.6 | 70.8 | 6.5 | 10.3 |
| | 9 | 65.5 | 81.6 | 23.4 | 72.4 | 7.2 | 9.7 |
| | 10 | 66.8 | 82.8 | 25.5 | 73.8 | 7.3 | 9.6 |
| Comparison materials | 11 | 65.5 | 77.3 | 17.1 | 54.7 | 2.1 | 7.5 |
| | 12 | 64.3 | 76.5 | 18.8 | 58.8 | 1.8 | 7.4 |
| | 13 | 65.6 | 76.8 | 20.1 | 60.4 | 3.5 | 6.8 |
| | 14 | 64.8 | 75.4 | 20.4 | 61.3 | 3.6 | 6.7 |
| | 15 | 64.8 | 76.6 | 21.3 | 60.4 | 1.4 | 5.4 |
| | 16 | 63.2 | 75.2 | 22.1 | 62.5 | 1.2 | 6.2 |
| | 17 | 64.4 | 80.8 | 20.6 | 62.1 | 1.3 | 6.9 |
| | 18 | 67.3 | 76.4 | 16.5 | 52.1 | 1.2 | 7.0 |
| | 19 | 65.6 | 75.3 | 17.3 | 54.5 | 1.4 | 7.5 |
| | 20 | 66.8 | 76.4 | 18.9 | 58.6 | 3.6 | 7.5 |

As understood from the results of the ordinary temperature tension tests, the ductility, such as elongation and reduction of area, and the impact value of the invented materials 1 are high stably to show a good weldability. Also, understood is that the creep rupture strength of the invented materials 1 is excellent markedly as compared with the comparison materials.

Next, a high Cr heat resistant cast steel material of a second embodiment according to the present invention is described. The high Cr heat resistant cast steel material of the second embodiment consists of carbon (C) of 0.08 to 0.14%, silicon (Si) of 0.10 to 0.30%, chromium (Cr) of 8 to 10%, nickel (Ni) of 0.01 to 0.60%, vanadium (V) of 0.1 to 0.2%, niobium (Nb) of 0.03 to 0.06%, nitrogen (N) of 0.02 to 0.07%, molybdenum (Mo) of 0.1 to 0.7%, tungsten (W) of 1 to 2.5%, cobalt of 0.01 to 2% and copper (Cu) of 0.02 to 2.5%, all in weight percent, and inevitable impurities and iron (Fe).

With respect to the second embodiment also, various tests have been done for confirmation of characteristics on invented materials 2 within the range of the above-mentioned components, as described below. Chemical components of the materials tested are shown in Table 4. The invented materials 1 shown in Table 4 are those tested in the first embodiment and are shown with same numbering of the test materials as in Table 1.

In these tests also, the test materials are prepared and tested in the same way as in the tests of the first embodiment. That is, all the materials are melted by a 50 kg vacuum high frequency melting furnace and the molten metal is poured into a sand mold to form test materials, and quenching is applied in simulation that a thickness center portion of a steam turbine casing which is 400 mm thick is quenched and cooled by air and then tempering is applied at a tempering temperature of each material decided such that the 0.2% yield strength corresponds to approximately 63 to 68 kgf/mm$^2$.

Table 5 shows the mechanical characters and the creep rupture strength (extrapolated value) after 100,000 hours at temperature of 625° C. as the results of various tests made on the invented materials 2 in comparison with the invented materials 1 and the comparison materials. The comparison materials shown in Table 5 are those tested in the first embodiment and are shown with same numbering of the test materials as in Table 2.

TABLE 4

| Classification | Nos. of Test materials | C | Si | Mn | Cr | Ni | V | Nb | Mo | W | Co | Cu | N |
|---|---|---|---|---|---|---|---|---|---|---|---|---|---|
| Invented materials 1 | 3 | 0.12 | 0.28 | 0.01 | 9.0 | 0.50 | 0.17 | 0.04 | 0.65 | 1.2 | 1.9 | 0.02 | 0.04 |
| | 8 | 0.10 | 0.18 | 0.00 | 9.7 | 0.55 | 0.15 | 0.05 | 0.15 | 2.4 | 1.9 | 0.02 | 0.04 |
| | 10 | 0.10 | 0.17 | 0.01 | 9.0 | 0.10 | 0.12 | 0.04 | 0.35 | 2.5 | 1.5 | 0.02 | 0.05 |
| Invented materials 2 | 21 | 0.12 | 0.28 | 0.01 | 9.0 | 0.50 | 0.18 | 0.04 | 0.65 | 1.2 | 1.9 | 0.54 | 0.04 |
| | 22 | 0.11 | 0.18 | 0.01 | 9.5 | 0.51 | 0.16 | 0.05 | 0.15 | 2.4 | 1.9 | 1.25 | 0.04 |
| | 23 | 0.10 | 0.18 | 0.01 | 9.0 | 0.11 | 0.12 | 0.05 | 0.35 | 2.5 | 1.5 | 2.22 | 0.05 |
| | 24 | 0.12 | 0.21 | 0.01 | 9.0 | 0.35 | 0.15 | 0.05 | 0.31 | 1.8 | 1.9 | 1.83 | 0.05 |
| | 25 | 0.10 | 0.22 | 0.01 | 9.0 | 0.35 | 0.15 | 0.05 | 0.28 | 1.8 | 1.9 | 1.65 | 0.05 |

TABLE 5

| Classification | Nos. of Test materials | Ordinary temperature tension tests: 0.2% Yield strength (kgf/mm$^2$) | Tension strength (kgf/mm$^2$) | Elongation (%) | Reduction of area (%) | 2 mmV Impact value at 20° C. (kgf-m) | 625° C. × $10^5$ hours: Creep rupture strength (kgf/mm$^2$) |
|---|---|---|---|---|---|---|---|
| Invented materials 1 | 3 | 65.4 | 78.8 | 21.2 | 67.9 | 5.6 | 10.3 |
| | 8 | 67.8 | 82.7 | 23.6 | 70.8 | 6.5 | 10.3 |
| | 10 | 66.8 | 82.8 | 25.5 | 73.8 | 7.3 | 9.6 |
| Invented materials 2 | 21 | 65.5 | 80.4 | 24.6 | 68.8 | 5.8 | 11.2 |
| | 22 | 66.4 | 81.2 | 25.6 | 69.2 | 6.8 | 11.1 |
| | 23 | 65.8 | 81.2 | 24.8 | 68.8 | 7.4 | 10.8 |
| | 24 | 65.5 | 81.1 | 23.7 | 72.3 | 7.4 | 11.0 |
| | 25 | 67.8 | 78.5 | 20.5 | 72.5 | 7.2 | 10.9 |
| Comparison materials | 11 | 65.5 | 77.3 | 17.1 | 54.7 | 2.1 | 7.5 |
| | 12 | 64.3 | 76.5 | 18.8 | 58.8 | 1.8 | 7.4 |
| | 13 | 65.6 | 76.8 | 20.1 | 60.4 | 3.5 | 6.8 |
| | 14 | 64.8 | 75.4 | 20.4 | 61.3 | 3.6 | 6.7 |
| | 15 | 64.8 | 76.6 | 21.3 | 60.4 | 1.4 | 5.4 |
| | 16 | 63.2 | 75.2 | 22.1 | 62.5 | 1.2 | 6.2 |
| | 17 | 64.4 | 80.8 | 20.6 | 62.1 | 1.3 | 6.9 |
| | 18 | 67.3 | 76.4 | 16.5 | 52.1 | 1.2 | 7.0 |
| | 19 | 65.6 | 75.3 | 17.3 | 54.5 | 1.4 | 7.5 |
| | 20 | 66.8 | 76.4 | 18.9 | 58.6 | 3.6 | 7.5 |

The test results shown in Table 5 are first compared between the comparison materials and the invented materials 2 As shown there, the ordinary temperature tension characteristics and the creep rupture characteristics show far excellent characteristics as compared with the comparison materials.

Then, the invented materials 2 are compared with the invented materials 1 As shown in Table 5, the ordinary temperature tension characteristics and the impact characteristics are not much different between the invented materials 1 and 2 and enhancement of the characteristics of the materials by addition of Cu is not seen.

In this embodiment also, tests have been done for confirmation of characteristics on invented materials 3 within the range of the above-mentioned components, and contents and results thereof are described below. Chemical components of the materials tested are shown in Table 6.

The invented materials 1 and 2 shown in Table 6 are the invented materials tested in the first and second embodiments and are shown with same numbering of the test materials as in Tables 1 and 4.

TABLE 6

| Classification | Nos. of Test materials | C | Si | Mn | Cr | Ni | V | Nb | Mo | W | Co | Cu | B | N |
|---|---|---|---|---|---|---|---|---|---|---|---|---|---|---|
| Invented materials 1 | 3 | 0.12 | 0.28 | 0.01 | 9.0 | 0.50 | 0.17 | 0.04 | 0.65 | 1.2 | 1.9 | 0.02 | 0.000 | 0.04 |
| | 10 | 0.10 | 0.17 | 0.01 | 9.0 | 0.10 | 0.12 | 0.04 | 0.35 | 2.5 | 1.5 | 0.02 | 0.000 | 0.05 |
| Invented materials 2 | 22 | 0.11 | 0.18 | 0.01 | 9.5 | 0.51 | 0.16 | 0.05 | 0.15 | 2.4 | 1.9 | 1.25 | 0.000 | 0.04 |
| | 23 | 0.10 | 0.18 | 0.01 | 9.0 | 0.11 | 0.12 | 0.05 | 0.35 | 2.5 | 1.5 | 2.22 | 0.000 | 0.05 |
| | 25 | 0.10 | 0.22 | 0.01 | 9.0 | 0.35 | 0.15 | 0.05 | 0.28 | 1.8 | 1.9 | 1.65 | 0.000 | 0.05 |
| Invented materials 3 | 31 | 0.12 | 0.25 | 0.01 | 9.1 | 0.48 | 0.16 | 0.04 | 0.61 | 1.3 | 1.9 | 0.02 | 0.003 | 0.04 |
| | 32 | 0.10 | 0.19 | 0.01 | 9.2 | 0.11 | 0.13 | 0.04 | 0.35 | 2.5 | 1.5 | 0.02 | 0.006 | 0.05 |
| | 33 | 0.11 | 0.18 | 0.01 | 9.5 | 0.51 | 0.16 | 0.05 | 0.18 | 2.4 | 1.9 | 1.25 | 0.005 | 0.04 |
| | 34 | 0.11 | 0.18 | 0.01 | 9.0 | 0.11 | 0.13 | 0.05 | 0.32 | 2.5 | 1.5 | 2.22 | 0.007 | 0.05 |
| | 35 | 0.11 | 0.20 | 0.01 | 9.1 | 0.37 | 0.15 | 0.05 | 0.28 | 1.8 | 1.9 | 1.65 | 0.009 | 0.05 |

But, as seen clearly in the comparisons between similar steels (comparison between Nos. 3 and 21, Nos. 8 and 22 and Nos. 10 and 23, respectively, of the test materials), the creep rupture strength of the invented materials 2 is relatively high as compared with the invented materials 1 and it is found that the creep rupture strength, that is, the high temperature strength, is further improved by addition of Cr.

Next, a high Cr heat resistant cast steel material of a third embodiment according to the present invention is described. The high Cr heat resistant cast steel material of the third embodiment is added with boron (B) of 0.002 to 0.010% to the high Cr heat resistant cast steels of the above-mentioned first and second embodiments.

In these tests also, the test materials are prepared and tested in the same way as in the tests of the first and second embodiments. That is, all the materials are melted by a 50 kg vacuum high frequency melting furnace and the molten metal is poured into a sand mold to form test materials, and quenching is applied in simulation that a thickness center portion of a steam turbine casing which is 400 mm thick is quenched and cooled by air and then tempering is applied at a tempering temperature of each material decided such that the 0.2% yield strength corresponds to approximately 63 to 68 kgf/mm$^2$.

Table 7 shows the mechanical characters and the creep rupture strength (extrapolated value) after 100,000 hours at temperature of 625° C. as the results of various tests made on the invented materials 3 in comparison with the invented materials 1 and 2 and the comparison materials. The comparison materials shown in Table 7 are those shown in Table 2.

TABLE 7

| Classification | Nos. of Test materials | Ordinary temperature tension tests: 0.2% Yield strength (kgf/mm$^2$) | Tension strength (kgf/mm$^2$) | Elongation (%) | Reduction of area (%) | 2 mmV Impact value at 20° C. (kgf-m) | 625° C. × $10^5$ hours Creep rupture strength (kgf/mm$^2$) |
|---|---|---|---|---|---|---|---|
| Invented materials 1 | 3 | 65.4 | 78.8 | 21.2 | 67.9 | 5.6 | 10.3 |
| | 10 | 66.8 | 82.8 | 25.5 | 73.8 | 7.3 | 9.6 |
| Invented materials 2 | 22 | 66.4 | 81.2 | 25.6 | 69.2 | 6.8 | 11.1 |
| | 23 | 65.8 | 81.2 | 24.8 | 68.8 | 7.4 | 10.8 |
| | 25 | 67.8 | 78.5 | 20.5 | 72.5 | 7.2 | 10.9 |
| Invented materials 3 | 31 | 65.4 | 79.8 | 22.3 | 72.6 | 5.8 | 11.2 |
| | 32 | 66.5 | 80.2 | 26.6 | 74.5 | 7.1 | 10.5 |
| | 33 | 65.7 | 81.6 | 25.8 | 73.8 | 6.7 | 12.3 |
| | 34 | 65.4 | 80.6 | 25.6 | 72.8 | 7.4 | 11.9 |
| | 35 | 64.4 | 80.2 | 22.7 | 74.5 | 7.0 | 12.1 |
| Comparison materials | 11 | 65.5 | 77.3 | 17.1 | 54.7 | 2.1 | 7.5 |
| | 12 | 64.3 | 76.5 | 18.8 | 58.8 | 1.8 | 7.4 |
| | 13 | 65.6 | 76.8 | 20.1 | 60.4 | 3.5 | 6.8 |
| | 14 | 64.8 | 75.4 | 20.4 | 61.3 | 3.6 | 6.7 |
| | 15 | 64.8 | 76.6 | 21.3 | 60.4 | 1.4 | 5.4 |
| | 16 | 63.2 | 75.2 | 22.1 | 62.5 | 1.2 | 6.2 |
| | 17 | 64.4 | 80.8 | 20.6 | 62.1 | 1.3 | 6.9 |
| | 18 | 67.3 | 76.4 | 16.5 | 52.1 | 1.2 | 7.0 |
| | 19 | 65.6 | 75.3 | 17.3 | 54.5 | 1.4 | 7.5 |
| | 20 | 66.8 | 76.4 | 18.9 | 58.6 | 3.6 | 7.5 |

The test results shown in Table 7 are first compared between the comparison materials and the invented materials 3 As shown there, the ordinary temperature tension characteristics and the creep rupture characteristics of the invented materials 3 show far excellent characteristics, same as the invented materials 1 and 2, as compared with the comparison materials.

Then, the invented materials 3 are compared with the invented materials 1 and 2. As seen in the comparisons between similar steels (comparison between Nos. 3 and 31, Nos. 10 and 32 and Nos. 22 and 34, respectively, of the test materials), the invented materials 3 to which B is added is enhanced of its characteristics of ductility (elongation, reduction of area) and creep rupture strength in the ordinary temperature tension tests. That is, it is found that the ordinary temperature ductility and creep rupture strength are enhanced by addition of B to show an excellent material characteristics.

Next, a high Cr heat resistant cast steel material of a fourth embodiment according to the present invention is described. The high Cr heat resistant cast steel material of the fourth embodiment consists of carbon (C) of 0.08 to 0.14%, silicon (Si) of 0.10 to 0.30%, manganese (Mn) of 0.01 to 1.0%, chromium (Cr) of 8.0 to 9.5%, nickel (Ni) of 0.01 to 0.60%, vanadium (V) of 0.1 to 0.2%, niobium (Nb) of 0.03 to 0.06%, nitrogen (N) of 0.02 to 0.07%, molybdenum (Mo) of 0.1 to 0.7%, tungsten (W) of 1.5 to 2.5% and cobalt of 0.01 to 2%, all in weight percent, and inevitable impurities and iron (Fe).

With respect to the fourth embodiment also, various tests have been done for confirmation of characteristics on invented materials 4 with the range of the above-mentioned components as well as on comparison materials, and contents and results thereof are described below. Chemical components of the materials tested are shown in Table 1 for the invented materials 4 and in Table 9 for the comparison materials.

TABLE 8

| Classification | Nos. of Test materials | C | Si | Mn | Cr | Ni | V | Nb | Mo | W | Co | N |
|---|---|---|---|---|---|---|---|---|---|---|---|---|
| Invented materials 4 | 41 | 0.11 | 0.18 | 0.59 | 9.2 | 0.49 | 0.13 | 0.05 | 0.30 | 2.0 | 1.5 | 0.050 |
| | 42 | 0.14 | 0.15 | 0.02 | 8.6 | 0.55 | 0.12 | 0.04 | 0.25 | 1.8 | 1.9 | 0.065 |
| | 43 | 0.13 | 0.14 | 0.89 | 8.6 | 0.05 | 0.13 | 0.05 | 0.30 | 1.9 | 1.9 | 0.050 |
| | 44 | 0.09 | 0.18 | 0.55 | 9.0 | 0.55 | 0.14 | 0.05 | 0.32 | 2.2 | 1.8 | 0.067 |
| | 45 | 0.13 | 0.12 | 0.60 | 8.7 | 0.60 | 0.14 | 0.05 | 0.28 | 2.1 | 0.5 | 0.068 |
| | 46 | 0.12 | 0.25 | 0.34 | 9.1 | 0.65 | 0.18 | 0.06 | 0.30 | 1.6 | 1.7 | 0.035 |
| | 47 | 0.12 | 0.18 | 0.62 | 9.0 | 0.54 | 0.13 | 0.05 | 0.20 | 2.0 | 1.0 | 0.055 |

TABLE 9

| Classification | Nos. of Test materials | C | Si | Mn | Cr | Ni | V | Nb | Mo | W | Co | N |
|---|---|---|---|---|---|---|---|---|---|---|---|---|
| Comparison materials | 51 | 0.10 | 0.18 | 0.60 | ※10.5 | 0.20 | 0.15 | 0.05 | 0.20 | ※0.7 | 0.5 | ※0.012 |
| | 52 | ※0.25 | ※0.38 | ※1.05 | 9.0 | 0.40 | 0.18 | ※0.08 | ※0.82 | ※2.8 | 1.8 | ※0.082 |
| | 53 | ※0.06 | 0.28 | 0.15 | 9.5 | 0.15 | 0.16 | 0.06 | 0.45 | ※2.9 | 0.5 | 0.025 |
| | 54 | 0.08 | ※0.65 | 0.55 | 9.4 | 0.42 | ※0.25 | 0.03 | 0.55 | ※1.2 | 1.0 | 0.045 |
| | 55 | ※0.07 | ※0.45 | 0.05 | 9.3 | 0.05 | ※0.22 | 0.05 | 0.31 | 2.0 | 0.1 | 0.035 |
| | 56 | 0.10 | ※0.35 | 0.45 | 8.3 | 0.55 | 0.15 | 0.05 | ※0.05 | ※1.4 | 1.2 | 0.055 |
| | 57 | 0.12 | 0.28 | 0.68 | 9.1 | ※0.85 | 0.15 | 0.04 | 0.54 | 1.3 | ※2.5 | 0.062 |
| | 58 | 0.13 | 0.27 | 0.85 | 9.3 | ※0.66 | ※0.08 | 0.05 | ※0.08 | 1.5 | 1.8 | 0.054 |

※mark shows a figure outside of the weight percent range of the present invention.

All the materials are melted by a 50 kg vacuum high frequency melting furnace and the molten metal is poured into a sand mold to form test materials. Each of the test materials obtained is cut into a riser portion and a test material piece and the riser portion is further cut into two portions. And one portion of the riser and the test material piece are applied by a heat treatment as follows.

As the heated treatment of the test materials, quenching is applied in simulation that a thickness center portion of a steam turbine casing which is 400 mm thick is quenched and cooled by air and then tempering is applied at a tempering temperature of each material decided such that the 0.2% yield strength corresponds to approximately 63 to 68 kgf/mm$^2$. Table 10 shows δ ferrite generation amount at the riser portion as cast and that after the heat treatment.

TABLE 10

| Classification | Nos. of Test materials | As cast (%) | After heat treatment* (%) |
|---|---|---|---|
| Invented materials 4 | 41 | 0.00 | 0.00 |
| | 42 | 0.01 | 0.00 |
| | 43 | 0.02 | 0.00 |
| | 44 | 0.00 | 0.00 |
| | 45 | 0.00 | 0.00 |
| | 46 | 0.04 | 0.00 |
| | 47 | 0.00 | 0.00 |
| Comparison materials | 51 | 0.45 | 0.14 |
| | 52 | 0.68 | 0.15 |
| | 53 | 0.75 | 0.21 |

TABLE 10-continued

| Classification | Nos. of Test materials | As cast (%) | After heat treatment* (%) |
|---|---|---|---|
| | 54 | 0.54 | 0.12 |
| | 55 | 0.38 | 0.14 |
| | 56 | 0.32 | 0.09 |
| | 57 | 0.25 | 0.10 |
| | 58 | 0.13 | 0.05 |

*: Heat treatment; 1100° C. × 10 hours
+1030° C. × 10 hours → Cooling in simulation of center portion of 400 mm thickness
Tempering in the range of +680 to 750° C. (10 hours)

According to Table 10, it is found that δ ferrite amount of the invented materials 4 as cast is low as compared with the comparison materials and if the invented materials 4 are applied by the heat treatment, then δ ferrite disappears completely. By contrast, in the comparison materials, the amount of δ ferrite generation is more as compared with the invented materials 4 regardless of the heat treatment. Also, δ ferrite remains even after the heat treatment and it is found that the comparison materials are not appropriate as cast steel materials.

Table 11 shows the mechanical characters and the creep rupture strength (extrapolated value) after 100,000 hours at temperature of 625° C. as the results of various tests made on the invented materials 4 and the comparison materials.

TABLE 11

| | | Ordinary temperature tension tests | | | | 2 mmV Impact | 625° C. × 10$^5$ hours |
|---|---|---|---|---|---|---|---|
| Classification | Nos. of Test materials | 0.2% Yield strength (kgf/mm$^2$) | Tension strength (kgf/mm$^2$) | Elongation (%) | Reduction of area (%) | value at 20° C. (kgf-m) | Creep rupture strength (kgf/mm$^2$) |
| Invented materials 4 | 41 | 65.4 | 80.3 | 22.4 | 68.8 | 8.4 | 10.2 |
| | 42 | 66.3 | 81.2 | 21.6 | 67.5 | 7.5 | 10.1 |
| | 43 | 65.5 | 80.8 | 23.8 | 70.2 | 7.9 | 9.8 |
| | 44 | 67.2 | 82.1 | 22.4 | 69.4 | 8.2 | 10.4 |
| | 45 | 64.8 | 79.8 | 23.5 | 71.1 | 7.4 | 9.7 |
| | 46 | 65.9 | 81.2 | 22.8 | 68.8 | 8.5 | 10.5 |
| | 47 | 65.8 | 80.5 | 25.6 | 72.8 | 9.2 | 9.7 |
| Comparison materials | 51 | 65.6 | 76.8 | 20.1 | 60.4 | 3.5 | 6.8 |
| | 52 | 68.3 | 77.6 | 16.2 | 54.8 | 1.3 | 6.5 |
| | 53 | 64.8 | 79.8 | 20.6 | 63.2 | 2.4 | 7.2 |
| | 54 | 65.5 | 80.4 | 19.5 | 58.4 | 5.3 | 6.9 |
| | 55 | 65.9 | 81.2 | 18.3 | 60.2 | 1.4 | 8.4 |
| | 56 | 64.8 | 77.6 | 19.2 | 59.5 | 5.2 | 7.5 |

TABLE 11-continued

| Classification | Nos. of Test materials | Ordinary temperature tension tests: 0.2% Yield strength (kgf/mm$^2$) | Tension strength (kgf/mm$^2$) | Elongation (%) | Reduction of area (%) | 2 mmV Impact value at 20° C. (kgf-m) | 625° C. × $10^5$ hours Creep rupture strength (kgf/mm$^2$) |
|---|---|---|---|---|---|---|---|
| | 57 | 66.3 | 79.4 | 20.4 | 62.8 | 6.7 | 6.8 |
| | 58 | 64.8 | 78.8 | 21.2 | 65.3 | 8.8 | 6.2 |

As understood from the results of the ordinary temperature tension tests, the ductility, such as elongation and reduction of area, and the impact value of the invented materials 4 are high stably to show a good weldability. By contrast, the ductility and the toughness of the comparison materials are relatively worsened. Also, understood is that the creep rupture strength of the invented materials 4 is excellent markedly as compared with the comparison materials.

Next, a high Cr heat resistant cast steel material of a fifth embodiment according to the present invention is described. The high Cr heat resistant cast steel material of the fifth embodiment consists of carbon (C) of 0.08 to 0.14%, silicon (Si) of 0.10 to 0.30%, manganese (Mn) of 0.01 to 1.0%, chromium (Cr) of 8.0 to 9.5%, nickel (Ni) of 0.01 to 0.60%, vanadium (V) of 0.1 to 0.2%, niobium (Nb) of 0.03 to 0.06%, nitrogen (N) of 0.02 to 0.07%, molybdenum (Mo) of 0.1 to 0.7%, tungsten (W) of 1.5 to 2.5%, cobalt of 0.01 to 2% and copper (Cu) of 0.02 to 2.5%, all in weight percent, and inevitable impurities and iron (Fe).

With respect to the fifth embodiment also, various tests have been done for confirmation of characteristics on invented materials 5 within the range of the above-mentioned components, and contents and results thereof are described below. Chemical components of the materials tested are shown in Table 12. The invented materials 4 shown in Table 12 are those tested in the fourth embodiment and are shown with the same numbering of the test materials as in Table 8.

TABLE 12

| Classification | Nos. of Test materials | C | Si | Mn | Cr | Ni | V | Nb | Mo | W | Co | Cu | N |
|---|---|---|---|---|---|---|---|---|---|---|---|---|---|
| Invented materials 4 | 41 | 0.11 | 0.18 | 0.59 | 9.2 | 0.49 | 0.13 | 0.05 | 0.30 | 2.0 | 1.5 | 0.02 | 0.050 |
| | 42 | 0.14 | 0.15 | 0.02 | 8.6 | 0.55 | 0.12 | 0.04 | 0.25 | 1.8 | 1.9 | 0.02 | 0.065 |
| | 43 | 0.13 | 0.14 | 0.89 | 8.6 | 0.05 | 0.13 | 0.05 | 0.30 | 1.9 | 1.9 | 0.02 | 0.050 |
| | 46 | 0.12 | 0.25 | 0.34 | 9.1 | 0.65 | 0.18 | 0.06 | 0.30 | 1.6 | 1.7 | 0.02 | 0.035 |
| Invented materials 5 | 61 | 0.12 | 0.16 | 0.61 | 9.2 | 0.55 | 0.14 | 0.05 | 0.29 | 2.0 | 1.6 | 1.25 | 0.050 |
| | 62 | 0.13 | 0.16 | 0.03 | 8.5 | 0.50 | 0.13 | 0.05 | 0.28 | 1.9 | 1.9 | 2.22 | 0.055 |
| | 63 | 0.14 | 0.13 | 0.88 | 8.6 | 0.06 | 0.13 | 0.04 | 0.32 | 1.9 | 1.9 | 1.65 | 0.045 |
| | 64 | 0.13 | 0.24 | 0.35 | 9.2 | 0.56 | 0.17 | 0.05 | 0.31 | 1.7 | 1.6 | 1.84 | 0.033 |
| | 65 | 0.13 | 0.18 | 0.65 | 9.1 | 0.55 | 0.14 | 0.05 | 0.29 | 2.0 | 1.0 | 1.21 | 0.051 |

In these tests also, the test materials are prepared and tested in the same way as in the tests of the fourth embodiment. That is, all the materials are melted by a 50 kg vacuum high frequency melting furnace and the molten metal is poured into a sand mold to form test materials. Each of the test materials obtained is cut into a riser portion and a test material piece and the riser portion is further cut into two portions. And one portion thereof and the test material piece are applied by a heat treatment as follows.

As the heat treatment of the test materials, quenching is applied in simulation that a thickness center portion of a steam turbine casing which is 400 mm thick is quenched and cooled by air and then tempering is applied at a tempering temperature of each material decided such that the 0.2% yield strength corresponds to approximately 63 to 68 kgf/mm$^2$. Table 13 shows δ ferrite generation amount at the riser portion as cast and that after the heat treatment.

TABLE 13

| Classification | Nos. of Test materials | As cast (%) | After heat treatment* (%) |
|---|---|---|---|
| Invented materials 4 | 41 | 0.00 | 0.00 |
| | 42 | 0.01 | 0.00 |
| | 43 | 0.02 | 0.00 |
| | 46 | 0.04 | 0.00 |
| Invented materials 5 | 61 | 0.00 | 0.00 |
| | 62 | 0.00 | 0.00 |
| | 63 | 0.00 | 0.00 |
| | 64 | 0.00 | 0.00 |
| | 65 | 0.00 | 0.00 |

*: Heat treatment; 1100° C. × 10 hours
+1030° C. × 10 hours → Cooling in simulation of center portion of 400 mm thickness
Tempering in the range of +680 to 750° C. (10 hours)

according to table 13, no δ ferrite is generated in case of the materials 5, even if they are as cast. This shows that generation of δ ferrite is further suppressed by addition of Cu as compared with the invented material 4 and that the invented materials 5 hardly generates δ ferrite.

Table 14 shows the mechanical characters and the creep rupture strength (extrapolated value) after 100,000 hours at temperature of 625° C., in comparison with the invented materials 4, as the results of various tests made on the invented materials 5.

TABLE 14

| Classification | Nos. of Test materials | Ordinary temperature tension tests: 0.2% Yield strength (kgf/mm$^2$) | Tension strength (kgf/mm$^2$) | Elongation (%) | Reduction of area (%) | 2 mmV Impact value at 20° C. (kgf-m) | 625° C. × $10^5$ hours Creep rupture strength (kgf/mm$^2$) |
|---|---|---|---|---|---|---|---|
| Invented materials 4 | 41 | 65.4 | 80.3 | 22.4 | 68.8 | 8.4 | 10.2 |
| | 42 | 66.3 | 81.2 | 21.6 | 67.5 | 7.5 | 10.1 |
| | 43 | 65.5 | 80.8 | 23.8 | 70.2 | 7.9 | 9.8 |
| | 46 | 65.9 | 81.2 | 22.8 | 68.8 | 8.5 | 10.5 |
| Invented materials 5 | 61 | 66.2 | 81.8 | 22.4 | 67.8 | 8.6 | 9.8 |
| | 62 | 65.1 | 80.8 | 23.2 | 68.4 | 8.2 | 9.9 |
| | 63 | 65.8 | 80.2 | 21.7 | 67.9 | 8.1 | 9.7 |
| | 64 | 64.5 | 79.8 | 22.8 | 65.4 | 8.4 | 10.1 |
| | 65 | 65.2 | 81.4 | 24.5 | 66.8 | 8.5 | 10.2 |

As shown in Table 14, the invented materials 4 and 5 are not very much different from each other in the ordinary tension test characteristics and impact characteristics and there is seen no influence of addition of Cu. But, as the invented materials 5 are excellent in ductility and impact characteristics as compared with the comparison material shown in Table 11, it is found that the invented materials 5 have a good mechanical character.

Next, a high Cr heat resistant cast steel material of a sixth embodiment according to the present invention is described. The high Cr heat resistant cast steel material of the sixth embodiment is added with boron (B) of 0.002 to 0.010% to the high Cr heat resistant cast steels of the above-mentioned fourth and fifth embodiments.

In this embodiment also, tests have been done for confirmation of characteristics on invented materials 6 within the range of the above-mentioned components, and contents and results thereof are described below. Chemical components of the materials tested are shown in Table 15.

The invented materials 4 and 5 shown in Table 15 are the invented materials tested in the fourth and fifth embodiments and are shown with same numbering of the test materials as in Tables 8 and 12.

In these tests also, the test materials are prepared and tested in the same way as in the tests of the fourth and fifth embodiments. That is, all the materials are melted by a 50 kg vacuum high frequency melting furnace and the molten metal is poured into a sand mold to form test materials. Each of the test materials obtained is cut into a riser portion and a test material piece and the riser portion is further cut into two portions. And one portion thereof and the test material piece are applied by a heat treatment as follows.

As the heat treatment of the test materials, quenching is applied in simulation that a thickness center portion of a steam turbine casing which is 400 mm thick is quenched and cooled by air and then tempering is applied at a tempering temperature of each material decided such that the 0.2% yield strength corresponds to approximately 63 to 68 kgf/mm$^2$. Table 16 shows δ ferrite generation amount at the riser portion as cast and that after the heat treatment.

TABLE 16

| Classification | Nos. of Test materials | As cast (%) | After heat treatment* (%) |
|---|---|---|---|
| Invented materials 4 | 41 | 0.00 | 0.00 |
| | 43 | 0.02 | 0.00 |
| Invented materials 5 | 61 | 0.00 | 0.00 |
| | 63 | 0.00 | 0.00 |
| | 65 | 0.00 | 0.00 |
| Invented materials 6 | 71 | 0.00 | 0.00 |
| | 72 | 0.00 | 0.00 |
| | 73 | 0.00 | 0.00 |

TABLE 15

| Classification | Nos. of Test materials | C | Si | Mn | Cr | Ni | V | Nb | Mo | W | Co | Cu | B | N |
|---|---|---|---|---|---|---|---|---|---|---|---|---|---|---|
| Invented materials 4 | 41 | 0.11 | 0.18 | 0.59 | 9.2 | 0.49 | 0.13 | 0.05 | 0.30 | 2.0 | 1.5 | 0.02 | 0.060 | 0.050 |
| | 43 | 0.13 | 0.14 | 0.89 | 8.6 | 0.05 | 0.13 | 0.05 | 0.30 | 1.9 | 1.9 | 0.02 | 0.000 | 0.050 |
| Invented materials 5 | 61 | 0.12 | 0.16 | 0.61 | 9.2 | 0.55 | 0.14 | 0.05 | 0.29 | 2.0 | 1.6 | 1.25 | 0.000 | 0.050 |
| | 63 | 0.14 | 0.13 | 0.88 | 8.6 | 0.06 | 0.13 | 0.04 | 0.32 | 1.9 | 1.9 | 1.65 | 0.000 | 0.045 |
| | 65 | 0.13 | 0.18 | 0.65 | 9.1 | 0.55 | 0.14 | 0.05 | 0.29 | 2.0 | 1.0 | 1.21 | 0.000 | 0.051 |
| Invented materials 6 | 71 | 0.11 | 0.18 | 0.62 | 9.2 | 0.48 | 0.12 | 0.05 | 0.32 | 2.1 | 1.5 | 0.02 | 0.003 | 0.04 |
| | 72 | 0.13 | 0.15 | 0.89 | 8.6 | 0.05 | 0.13 | 0.05 | 0.30 | 1.9 | 1.9 | 0.02 | 0.006 | 0.05 |
| | 73 | 0.12 | 0.16 | 0.62 | 9.1 | 0.54 | 0.14 | 0.05 | 0.30 | 2.0 | 1.7 | 1.26 | 0.005 | 0.04 |
| | 74 | 0.13 | 0.14 | 0.89 | 8.6 | 0.07 | 0.13 | 0.04 | 0.31 | 1.8 | 1.9 | 1.65 | 0.007 | 0.05 |
| | 75 | 0.13 | 0.19 | 0.64 | 9.2 | 0.58 | 0.13 | 0.05 | 0.28 | 2.0 | 1.1 | 1.18 | 0.009 | 0.05 |

TABLE 16-continued

| Classification | Nos. of Test materials | As cast (%) | After heat treatment* (%) |
|---|---|---|---|
| | 74 | 0.00 | 0.00 |
| | 75 | 0.00 | 0.00 |

*: Heat treatment; 1100° C. × 10 hours
+1030° C. × 10 hours → Cooling in simulation of center portion of 400 mm thickness
Tempering in the range of +680 to 750° C. (10 hours)

In case of the invented materials 6, they show same behavior of δ ferrite generation as the similar steels to the invented material 4 and 5. That is, the similar steel to the test material No. 71 is the test material No. 41, the similar steel to the test material No. 72 is the test material No. 43, and then likewise the similar steel is 73→61→63 and 75→65, respectively, and it is seen that generation of δ ferrite is not influenced by addition addition of B. In any case, in the invented materials 4, 5 and 6, δ ferrite disappears completely after the heat treatment and there occurs no problem of δ ferrite.

Table 17 shows the mechanical characters and the creep rupture strength (extrapolated value) after 100,000 hours at temperature of 625° C., in comparison with the invented materials 4 and 5, as the results of various tests made on the invented materials 6.

As seen from comparisons with the similar steels (comparisons between the test material Nos. 41 and 71, and likewise between Nos. 43 and 72, Nos. 61 and 73, Nos. 63 and 74 and Nos. 65 and 75, respectively), the invented materials 4 to which B is added are same to or higher than the similar steels in the ductility (elongation, reduction of area) in the ordinary temperature tension tests and are more excellent than the similar steels in the creep rupture strength. That is, the ordinary temperature ductility and creep rupture strength are enhanced by addition of B so as to have an excellent material characteristics.

Next, a high Cr heat resistant cast steel material of a seventh embodiment according to the present invention is described. The high Cr heat resistant cast steel material of the seventh embodiment is added with calcium (Ca) of 0.001 to 0.009% to the high Cr heat resistant cast steels of the above-mentioned first, second, third, fourth, fifth and sixth embodiments.

In this embodiment also, tests have been done for confirmation of characteristics on invented materials 7 within the range of the above-mentioned components, and contents and results thereof are described below. Chemical components of the materials tested are shown in Tables 18 and 19.

TABLE 17

| | | Ordinary temperature tension tests | | | | 2 mmV Impact | 625° C. × $10^5$ hours |
|---|---|---|---|---|---|---|---|
| Classification | Nos. of Test materials | 0.2% Yield strength (kgf/mm$^2$) | Tension strength (kgf/mm$^2$) | Elongation (%) | Reduction of area (%) | value at 20° C. (kgf-m) | Creep rupture strength (kgf/mm$^2$) |
| Invented materials 4 | 41 | 65.4 | 80.3 | 22.4 | 68.8 | 8.4 | 10.2 |
| | 43 | 65.5 | 80.8 | 23.8 | 70.2 | 7.9 | 9.8 |
| Invented materials 5 | 61 | 66.2 | 81.8 | 22.4 | 67.8 | 8.6 | 9.8 |
| | 63 | 65.8 | 80.2 | 21.7 | 67.9 | 8.1 | 9.7 |
| | 65 | 65.2 | 81.4 | 24.5 | 66.8 | 8.5 | 10.2 |
| Invented materials 6 | 71 | 64.5 | 80.2 | 23.5 | 69.5 | 8.6 | 11.2 |
| | 72 | 65.9 | 81.7 | 24.1 | 70.2 | 8.2 | 10.5 |
| | 73 | 65.8 | 81.0 | 24.5 | 68.9 | 8.7 | 10.4 |
| | 74 | 66.2 | 82.1 | 24.6 | 68.8 | 8.4 | 10.3 |
| | 75 | 64.8 | 85.4 | 24.8 | 68.2 | 8.9 | 11.3 |

TABLE 18

| Classification | Nos. of Test materials | C | Si | Mn | Cr | Ni | V | Nb | Mo | W | Co | Cu | B | N | Ca |
|---|---|---|---|---|---|---|---|---|---|---|---|---|---|---|---|
| Invented materials 1 | 3 | 0.12 | 0.28 | 0.01 | 9.0 | 0.50 | 0.17 | 0.04 | 0.65 | 1.2 | 1.9 | 0.02 | 0.000 | 0.04 | 0.000 |
| Invented materials 2 | 22 | 0.11 | 0.18 | 0.01 | 9.5 | 0.51 | 0.16 | 0.05 | 0.15 | 2.4 | 1.9 | 1.25 | 0.000 | 0.04 | 0.000 |
| Invented materials 3 | 31 | 0.12 | 0.25 | 0.01 | 9.1 | 0.48 | 0.16 | 0.04 | 0.61 | 1.3 | 1.9 | 0.02 | 0.003 | 0.04 | 0.000 |
| | 35 | 0.11 | 0.20 | 0.01 | 9.1 | 0.37 | 0.15 | 0.05 | 0.28 | 1.8 | 1.9 | 1.65 | 0.009 | 0.05 | 0.000 |
| Invented materials 4 | 43 | 0.13 | 0.14 | 0.89 | 8.6 | 0.05 | 0.13 | 0.05 | 0.30 | 1.9 | 1.9 | 0.02 | 0.000 | 0.050 | 0.000 |
| Invented materials 5 | 61 | 0.12 | 0.16 | 0.61 | 9.2 | 0.55 | 0.14 | 0.05 | 0.29 | 2.0 | 1.6 | 1.25 | 0.000 | 0.050 | 0.000 |
| Invented materials 6 | 71 | 0.11 | 0.18 | 0.62 | 9.2 | 0.48 | 0.12 | 0.05 | 0.32 | 2.1 | 1.5 | 0.02 | 0.003 | 0.04 | 0.000 |
| | 73 | 0.12 | 0.16 | 0.62 | 9.1 | 0.54 | 0.14 | 0.05 | 0.30 | 2.0 | 1.7 | 1.26 | 0.005 | 0.04 | 0.000 |

TABLE 19

| Classification | Nos. of Test materials | C | Si | Mn | Cr | Ni | V | Nb | Mo | W | Co | Cu | B | N | Ca |
|---|---|---|---|---|---|---|---|---|---|---|---|---|---|---|---|
| Invented materials 7 | 81 | 0.11 | 0.26 | 0.01 | 8.9 | 0.50 | 0.18 | 0.04 | 0.63 | 1.2 | 1.9 | 0.02 | 0.000 | 0.047 | 0.005 |
| | 82 | 0.11 | 0.20 | 0.01 | 9.4 | 0.48 | 0.16 | 0.05 | 0.16 | 2.4 | 1.8 | 1.22 | 0.000 | 0.041 | 0.006 |
| | 83 | 0.12 | 0.25 | 0.01 | 9.1 | 0.49 | 0.15 | 0.04 | 0.60 | 1.3 | 1.9 | 0.02 | 0.004 | 0.042 | 0.004 |
| | 84 | 0.12 | 0.19 | 0.01 | 9.2 | 0.39 | 0.15 | 0.04 | 0.30 | 1.9 | 1.9 | 1.61 | 0.007 | 0.050 | 0.005 |
| | 85 | 0.13 | 0.13 | 0.86 | 8.6 | 0.05 | 0.13 | 0.05 | 0.31 | 1.9 | 1.9 | 0.01 | 0.000 | 0.018 | 0.003 |
| | 86 | 0.11 | 0.16 | 0.60 | 9.2 | 0.54 | 0.14 | 0.04 | 0.29 | 2.0 | 1.6 | 1.23 | 0.000 | 0.052 | 0.006 |
| | 87 | 0.11 | 0.16 | 0.59 | 9.3 | 0.48 | 0.12 | 0.05 | 0.31 | 2.1 | 1.5 | 0.02 | 0.004 | 0.043 | 0.005 |
| | 88 | 0.13 | 0.15 | 0.64 | 9.2 | 0.53 | 0.14 | 0.05 | 0.29 | 2.0 | 1.7 | 1.25 | 0.004 | 0.041 | 0.007 |
| Comparison materials | 91 | 0.13 | 0.14 | 0.85 | 8.6 | 0.05 | 0.13 | 0.05 | 0.30 | 1.9 | 1.9 | 0.01 | 0.000 | 0.045 | X0.012 |
| | 92 | 0.11 | 0.18 | 0.60 | 9.2 | 0.52 | 0.13 | 0.04 | 0.31 | 2.0 | 1.6 | 1.21 | 0.000 | 0.049 | X0.016 |
| | 93 | 0.12 | 0.16 | 0.60 | 9.3 | 0.48 | 0.12 | 0.05 | 0.30 | 2.1 | 1.5 | 0.02 | 0.005 | 0.045 | X0.020 |

X mark shows a figure outside of the weight percent range of the present invention.

In Tables 18 and 19, the invented materials 1 are the invented materials tested in the first embodiment, the invented materials 2 are the invented materials tested in the second embodiment, the invented materials 3 are the invented materials tested in the third embodiment, the invented materials 4 are the invented materials tested in the fourth embodiment, the invented materials 5 are the invented materials tested in the fifth embodiment and the invented materials 6 are the invented materials tested in the sixth embodiment, and these invented materials in said order are shown with same numbering of the test materials in Table 1, Table 4, Table 6, Table 8, Table 12 and Table 15, correspondingly.

It is to be noted that an analysis result of Ca which might be mixed as an impurity is not shown in Tables 1, 4, 6, 8, 12 and 15, but as shown in Table 18. Ca content was 0.000% in the invented materials 1, 2, 3, 4, 5 and 6. The comparison materials are those shown in Tables 2 and 9 and those shown in Table 19 (test material Nos. 91, 92 and 93).

The similar steel to the test material No. 81 is the test material No. 2, the similar steel to the test material No. 82 is the test material No. 22, and then likewise 83→31, 84→35, 85→43, 86→61, 87→71 and 88→73. Also, each of the test material Nos. 91, 92 and 93, which are classified into the comparison materials, is the material to which Ca is added more than the upper limit value of the invented materials 7 on the basis of components of the test material Nos. 85, 86 and 87, correspondingly, of the invented materials 7.

In these tests also, the test materials are prepared and tested in the same way as in the tests of the fourth, fifth and sixth embodiments. That is, all the materials are melted by a 50 kg vacuum high frequency melting furnace and the molten metal is poured into a sand mold to form test materials. Each of the test materials obtained is cut into a riser portion and a test material piece and the riser portion is further cut into two portions. And one portion thereof and the test material piece are applied by a heat treatment as follows.

As the heat treatment of the test materials, quenching is applied in simulation that a thickness center portion of a steam turbine casing which is 400 mm thick is quenched and cooled by air and then tempering is applied at a tempering temperature of each material decided such that the 0.2% yield strength corresponds to approximately 63 to 68 kgf/mm$^2$. Table 20 shows δ ferrite generation amount at the riser portion as cast and that after the heat treatment.

TABLE 20

| Classification | Nos. of Test materials | As cast (%) | After heat treatment* (%) |
|---|---|---|---|
| Invented materials 1 | 3 | — | — |
| Invented materials 2 | 22 | — | — |
| Invented materials 3 | 31 | — | — |
| | 35 | — | — |
| Invented materials 4 | 43 | 0.00 | 0.00 |
| Invented materials 5 | 61 | 0.00 | 0.00 |
| Invented materials 6 | 71 | 0.00 | 0.00 |
| | 73 | 0.00 | 0.00 |
| Invented materials 7 | 81 | 0.05 | 0.00 |
| | 82 | 0.03 | 0.00 |
| | 83 | 0.01 | 0.00 |
| | 84 | 0.00 | 0.00 |
| | 85 | 0.00 | 0.00 |
| | 86 | 0.00 | 0.00 |
| | 87 | 0.00 | 0.00 |
| | 88 | 0.00 | 0.00 |
| Comparison materials | 91 | 0.00 | 0.00 |
| | 92 | 0.00 | 0.00 |
| | 93 | 0.00 | 0.00 |

*: Heat treatment; 1100° C. × 10 hours
+1030° C. × 10 hours → Cooling in simulation of center portion of 400 mm thickness
Tempering in the range of +680 to 750° C. (10 hours)

In the invented materials 7, very slight generations of δ ferrite are seen with respect to the test material Nos. 81, 82 and 83 if they are as cast but they disappear completely after the heat treatment, and there is no practical problem. Also, with respect to the test material Nos. 84, 85, 86, 87 and 88, there occurs no generation of δ ferrite even if they are as cast and a sound state of structure can be seen. That is, generation of δ ferrite is not influenced by addition of Ca. It is to be noted that, with respect to the comparison material Nos. 91, 92 and 93 also, to which Ca is added more than the upper limit value of the invented materials 7, there is no generation of δ ferrite.

Table 21 shows the mechanical characters and the creep rupture strength (extrapolated value) after 100,000 hours at temperature of 625° C., in comparison with the invented materials 1, 2, 3, 4, 5 and 6 and the comparison materials, as the results of various tests made on the invented materials 7.

TABLE 21

| Classification | Nos. of Test materials | Ordinary temperature tension tests: 0.2% Yield strength (kgf/mm$^2$) | Tension strength (kgf/mm$^2$) | Elongation (%) | Reduction of area (%) | 2 mmV Impact value at 20° C. (kgf-m) | 625° C. × $10^5$ hours Creep rupture strength (kgf/mm$^2$) |
|---|---|---|---|---|---|---|---|
| Invented materials 1 | 3 | 65.4 | 78.8 | 21.2 | 67.9 | 5.6 | 10.3 |
| Invented materials 2 | 22 | 66.4 | 81.2 | 25.6 | 69.2 | 6.8 | 11.1 |
| Invented materials 3 | 31 | 65.4 | 79.8 | 22.3 | 72.6 | 5.8 | 11.2 |
| | 35 | 64.4 | 80.2 | 22.7 | 74.5 | 7.0 | 12.1 |
| Invented materials 4 | 43 | 65.5 | 80.8 | 23.8 | 70.2 | 7.9 | 9.8 |
| Invented materials 5 | 61 | 66.2 | 81.8 | 22.4 | 67.8 | 8.6 | 9.8 |
| Invented materials 6 | 71 | 64.5 | 80.2 | 23.5 | 69.5 | 8.6 | 11.2 |
| | 73 | 65.8 | 81.0 | 24.5 | 68.9 | 8.7 | 10.4 |
| Invented materials 7 | 81 | 65.9 | 79.5 | 23.2 | 68.4 | 6.7 | 11.1 |
| | 82 | 65.4 | 81.0 | 25.3 | 69.9 | 8.0 | 11.7 |
| | 83 | 65.0 | 79.5 | 22.7 | 72.7 | 6.9 | 12.0 |
| | 84 | 65.3 | 81.2 | 23.0 | 74.1 | 7.7 | 12.8 |
| | 85 | 65.1 | 80.6 | 24.0 | 70.4 | 9.1 | 10.2 |
| | 86 | 65.7 | 81.2 | 23.0 | 69.8 | 10.5 | 10.4 |
| | 87 | 65.2 | 80.8 | 23.5 | 70.4 | 9.8 | 12.0 |
| | 88 | 66.0 | 81.3 | 24.4 | 70.2 | 10.2 | 11.1 |
| Comparison materials | 91 | 65.6 | 80.7 | 23.5 | 69.9 | 7.8 | 9.6 |
| | 92 | 66.0 | 81.4 | 21.9 | 65.4 | 7.7 | 9.0 |
| | 93 | 64.5 | 80.0 | 20.5 | 64.5 | 6.9 | 9.3 |

As seen from comparisons with the similar steels (comparisons between the test material Nos. 81 and 2, and likewise between Nos. 82 and 22, Nos. 83 and 31, Nos. 84 and 35, Nos. 85 and 43, Nos. 86 and 61, Nos. 87 and 71 and Nos. 88 and 73, respectively), the invented materials 7 to which Ca is added are same to or slightly higher than the similar steels in the ductility (elongation, reduction of area) in the ordinary temperature tension tests and a significant enhancement of characteristics is seen in the 2 mmV notch Charpy impact value (test temperature: 20° C.). Also, the creep rupture strength after 100,000 hours at temperature of 650° C. is enhanced securely as compared with the similar steels and the invented materials 7 can be said as having an excellent material characteristics.

On the other hand, as is clearly seen from comparisons between the test material Nos. 43, 85 and 91, Nos. 61, 86 and 91 and Nos. 71, 87 and 93, the comparison materials to which Ca is added more than the upper limit value of the invented materials 7 are deteriorated in the impact value and the creep rupture strength as compared with the invented materials 7 and the similar steels to the invented materials 7 and it is found that an excessive addition of Ca rather harms the material characteristics.

In the high Cr heat resistant cast steel material and the pressure vessel made thereof according to the present invention, the material consists of C, Si, Cr, Ni, V, Nb, N, Mo and W, in the respective predetermined weight percent, and inevitable impurities and Fe, and said material is added with Cu, B and Ca in the respective predetermined weight percent and is further added with Mn, Mn and Cu, B and Ca in the respective predetermined weight percent, thereby an excellent high temperature strength is given and a material which is useful as a high temperature steam turbine casing material for a ultra supercritical pressure power generation plant of steam temperature of 600° C. or more is realized, and further a pressure vessel by use of said material is formed, thereby the temperature presently used in the operation of the ultra supercritical pressure power generation plant can be elevated further to contribute to saving of fossil fuels and to suppress generation amount of carbon dioxide.

What is claimed is:

1. A high chromium heat resistant cast steel material comprising carbon of 0.08 to 0.14%, silicon of 0.10 to 0.30%, manganese of 0.01 to 1.0%, chromium of 8.0 to less than 9.5%, nickel of 0.01 to 0.60%, vanadium of 0.1 to 0.2%, niobium of 0.03 to 0.06%, nitrogen of 0.02 to 0.07%, molybdenum of 0.1 to 0.7%, tungsten of 1.5 to 2.5% and cobalt of 0.01 to 2%, calcium of 0.001 to 0.009%, all in weight percent, and inevitable impurities and iron.

2. A high chromium heat resistant cast steel material comprising carbon of 0.08 to 0.14%, silicon of 0.10 to 0.30%, manganese of 0.01 to 1.0%, chromium of 8.0 to less than 9.5%, nickel of 0.01 to 0.60%, vanadium of 0.1 to 0.2%, niobium of 0.03 to 0.06%, nitrogen of 0.02 to 0.07%, molybdenum of 0.1 to 0.7%, tungsten of 1.5 to 2.5%, cobalt of 0.01 to 2% and copper of 0.2 to 2.5%, calcium of 0.001 to 0.009%, all in weight percent, and inevitable impurities and iron.

3. A high chromium heat resistant cast steel material as claimed in any one of claims 1 and 2, additionally containing boron of 0.002 to 0.010% in weight percent.

4. A pressure vessel made from the high chromium heat resistant cast steel of claim 1.

5. A pressure vessel made from the high chromium heat resistant cast steel of claim 2.

6. A pressure vessel made from the high chromium heat resistant cast steel of claim 3.

* * * * *